United States Patent [19]

Storandt et al.

[11] 4,436,321

[45] Mar. 13, 1984

[54] ELECTRICALLY RELEASABLE SAFETY SKI BINDING

[75] Inventors: Ralf Storandt; Georg Scheck; Peter Biermann, all of Leonberg, Fed. Rep. of Germany

[73] Assignee: Geze GmbH, Fed. Rep. of Germany

[21] Appl. No.: 261,496

[22] Filed: May 7, 1981

[30] Foreign Application Priority Data

May 9, 1980 [DE] Fed. Rep. of Germany ..... 3017841

[51] Int. Cl.[3] ..... A63C 9/085

[52] U.S. Cl. ..... 280/612; 307/65

[58] Field of Search ..... 280/616, 618, 611, 612, 280/624, DIG. 13; 307/65, 66; 320/7, 8, 14, 15, 2, 61

[56] References Cited

U.S. PATENT DOCUMENTS

| | | | |
|---|---|---|---|
| 3,528,672 | 9/1970 | Wonder | 280/612 |
| 3,666,962 | 5/1972 | Bogue et al. | 307/65 |
| 3,731,943 | 5/1973 | Wilkes | 280/613 |
| 3,820,803 | 6/1974 | Frosch | 280/612 |
| 3,963,253 | 6/1976 | Rieger | 280/616 |
| 4,160,555 | 7/1979 | Salomon | 280/612 |

FOREIGN PATENT DOCUMENTS

| | | | |
|---|---|---|---|
| 2748309 | 5/1978 | Fed. Rep. of Germany . | |
| 2737535 | 3/1979 | Fed. Rep. of Germany . | |
| 2,907,939 | 9/1979 | Fed. Rep. of Germany | 280/DIG. 13 |
| 2927499 | 1/1981 | Fed. Rep. of Germany | 280/611 |
| 2938756 | 4/1981 | Fed. Rep. of Germany | 280/612 |

OTHER PUBLICATIONS

Hull and Allen, "Design of an Actively Controlled Snow Ski Release Binding", Journal of Bio. Mech. Engr., Aug. 1981, p. 145.

*Primary Examiner*—Joseph F. Peters, Jr.
*Assistant Examiner*—Timothy Roesch

[57] ABSTRACT

An electrically releasable safety ski binding in which a measuring system determines the load applied to a skier's leg during skiing and a release mechanism incorporating an electromechanical converter such as a solenoid acts on a clamp device securing the ski boot to the binding to release the ski boot when the aforementioned load reaches a dangerous level. To prevent the binding becoming inoperative on failure of the electrical power supply the binding is equipped with an auxiliary release mechanism having a first inoperative state and a second operative state which can be selected either manually or automatically should the electrically operated release mechanism fail.

22 Claims, 8 Drawing Figures

ELECTRICALLY RELEASABLE SAFETY SKI BINDING

Figure 1:
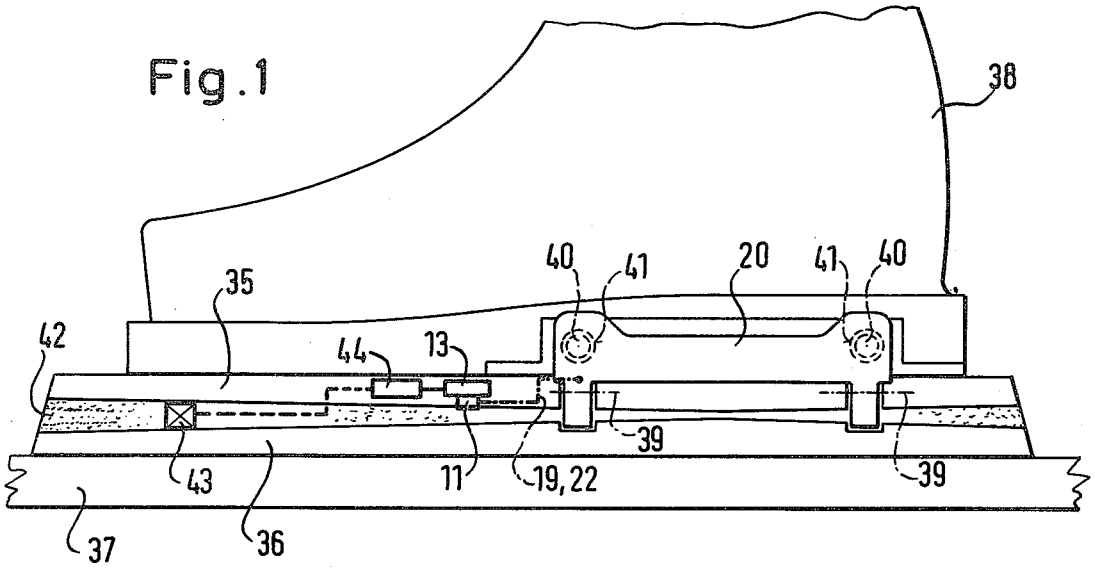

The present invention relates to an electrically releasable safety ski binding and has particular reference to a battery operated electrically releasable safety ski binding.

In known ski bindings of this kind such as are shown in German Published Application No. 27 37 535 and German Published Application No. 27 48 309 an electrical measuring transducer or transducers are used to measure the load acting on the skier's leg. A signal former is connected to the measuring transducer to form a release signal which is used to activate a release mechanism incorporating an electromagnetic converter, such as a solenoid, to release retaining means which secure the ski boot to the ski. Such retaining means are normally pivotable or displaceable away from the ski boot and the release mechanism can be of the mechanical, hydraulic or pneumatic types.

A general problem which arises with this type of safety ski binding is that they become inoperative when the battery which drives them has become discharged. As a result of this difficulty visual or acoustic battery condition indicators have been proposed in order to at least indicate the discharged state of the battery to the skier.

The use of shear pins has also been suggested in order to allow an emergency release to be effected in the event that the electrical release system fails. The shear pins are secured to a fitting on the ski boot and thus release the ski boot in an emergency if a fault should be present in the mechanical or electrical part of the normal release mechanisn. It is only possible to re-use a binding which has released by breakage of the shear pin by replacing the shear pin with a new one.

In addition to the problem of having to replace a broken shear pin the use of shear pins also suffers from the fundamental disadvantage that the release setting for the shear pin system must be higher than the release setting for the normal electrical release system.

As the electrical release system and the shear pin system are arranged in series the weakest of the two systems will yield when a load is applied to both release systems. As the electrical release system should normally release, the release setting of the shear pin system must naturally be higher than the maximum release value of the electronics release system. The difference between the two release settings also has to be relatively large because electrically operated bindings are also intended to remain closed during peak dynamic loads which would normally result in breakage of a shear pin system. As a result, an energency release of the binding when the electrical release system is not operating is practically impossible at a reasonable release value; unless one renounces the significant advantages of an electrically releasing ski binding, namely the ability to take account of the duration of shock loads.

The principal object underlying the invention is thus to provide a ski safety binding of the initially named kind which, when the battery is discharged or when some other fault exists in the electrical release system still has the release characteristics of a mechanical safety binding incorporating a release spring.

In order to satisfy this object there is provided in accordance with a first general form of the invention an electrically releasable safety ski binding comprising retaining means for releasably securing a ski boot to a ski, an electrical power supply, a measuring means for measuring the load applied to a skier's leg during skiing, a signal former connected to said measuring means for forming a release signal when said load approaches a predetermined level, a release mechanism incorporating an electromechanical converter such as a solenoid connected to receive said release signal and operative to initiate release of said retaining means on receipt of said release signal, said safety binding futher comprising an auxiliary release mechanism having a first inoperative state and a second operative state in which it is operative to permit safety release of the binding and wherein means are provided for selecting said second operative state on failure of said electrical power supply.

In accordance with a specially preferred embodiment of the invention there is provided an electrically releasable safety ski binding comprising retaining means for releasably securing a ski boot to a ski, an electrical power supply, measuring means for measuring the load applied to a skier's leg during skiing, a signal former connected to said measuring means for forming a release signal when said load approaches a predetermined level, a release mechanism incorporating an electromechanical converter such as a solenoid connected to receive said release signal and operative to initiate release of said retaining means on receipt of said release signal, said safety binding further comprising an auxiliary release mechanism incorporating resilient release movement permitting means and having a first, inoperative state and a second, operative state in which said resilient means is able to deflect resiliently to permit release of the binding on reaching a release setting thereof and means for selecting said second operative state on failure of said electrical power supply.

In accordance with a further aspect of the invention there is provided a battery operated, electrically releasing safety ski binding with an electrical measuring sensor which reponds to a predetermined load on the skier's leg, a signal former connected thereto for forming a release signal and a mechanical, hydraulic or pneumatic release mechanism having an electromechanical converter, such as a solenoid, with said release mechanism bringing about the release of retaining means which retain the ski boot on the ski and are pivotable or displaceable away from the ski boot on receiving the release signal via the converter, characterized in that, on failure of the power supply, a release spring braced against a fixed housing part can be inserted into the release mechanism in parallel with the electromechanical converter and that the electromechanical converter remains in a condition, or is placed in a condition in which the spring can yield on reaching the release setting.

In a ski safety binding of the latter kind which operates with a mechanical release system it is envisaged with a release mechanism which is normally operated with current, that one of the spring abutments is operatively connected with the element on which the spring bears or with a part fixed relative to the ski whereas the other spring abutment bears against a spring cage which is braced on the opposite spring abutment and that, on failure of the current supply, the spring cage is braced on a part which is fixed relative to the ski or on an element on which the spring is to act in place of the oppositely disposed abutment.

The basic thought underlying the invention is thus to be seen in the construction of the mechanical, hydraulic or pneumatic ski boot retaining systems used with an electrically operated ski safety binding so that when the electrical control fails a purely mechanical, hydraulic or pneumatic emergency release system comes into operation.

In accordance with the invention the mechanical, hydraulic or pneumatic emergency release system is however inoperative during normal operation with electrical control. Only when the electrical control fails is the emergency system rendered operative so that it in no way deleteriously affects the sensitive electrical release procedure. As, in the converse situation the electrical control is inoperative when the mechanical, hydraulic or pneumatic emergency release system becomes operative, and as both systems are connected in parallel, the release setting of the mechanical, hydraulic or pneumatic release system can be selected completely independently of the electrical release setting. This system does not therefore result in a need to select the mechanical, hydraulic or pneumatic release setting to be higher than the electrical release setting.

In accordance with a first, advantageous, practice embodiment the release of the retaining means takes place when the electromechanical converter becomes de-energised. In a system of this kind, in the event of a discharged battery or some other fault in the electrical system such as a short circuit, the retaining means are released so that it would normally not be possible to continue skiing with a binding of this kind. In accordance with the invention, however, it is only necessary to select the mechanical release system in order to be able to continue using the binding prior to inserting a new battery or repairing the electrical system.

The thought underlying the invention can however also be used with electrically releasable ski safety bindings in which the release of the retaining means occurs when the electromagnetic converter is energised. In this case it is however necessary to provide a suitable mechanical construction so that the push rod of the electromechanical converter is movable when the power supply fails.

In the first named type of electrical safety binding the push rod of an excited electromechanical converter normally holds the retaining means in the closed position via a transmission. In this case one of the abutments for the spring should be arranged on the push rod whereas the other abutment for the spring can be usefully braced against at least one slider which is selectively insertable transverse to the direction of operation of the spring and axially braced against a part fixed relative to the ski.

The slider can be brought by hand into operative connection with the other spring abutment. In a preferred embodiment, however, the slider is held by a further electromechanical converter, which is fed from the same power supply as the main converter, in its inoperative position against the force of an auxiliary spring in such a way that the auxiliary spring brings the slider into operative connection with the other spring abutment when the further electromagnetic converter becomes deenergised. In this manner the changeover from the electrical to the mechanical release system takes place automatically when the arrangement becomes deenergised.

The term "spring cage" as used in connection with the present invention will be understood to cover every form of mechanical arrangement which makes it possible to transmit the force of a compressed spring from the one spring abutment to the other spring abutment. The term will particularly be understood to cover a sleeve which surrounds the spring and has inwardly directed flanges at both ends to transfer the reaction forces. For the purposes of the invention the release spring preferably takes the form of a compression coil spring. It is however also possible to use other spring arrangements including several release springs connected in parallel.

One practical embodiment in which the push rod of an electromechanical converter brings about release of the binding on energization of the converter and is able to deflect when the converter becomes deenergised is characterized in that the push rod of the electromechanical converter operates on the overcenter pivot of a toggle lever which holds the binding closed and is extended or located trivially beyond the extended overcenter position and in that, on being energised, the electromagnetic converter moves the toggle lever out of the closed position beyond the overcenter point into an open position.

In the simplest case the push rod can again be moved by hand into the open position. In a preferred embodiment the changeover from electrical to mechanical release can however again take place automatically by using an arrangement in which a slider is held by a further electromagnetic converter, which is supplied from the same power supply as the main converter, in its inoperative position against the force of an auxiliary spring in such a way that the auxiliary spring pushes the toggle joint beyond its overcenter position into the open position via the slider when the further electromagnetic converter becomes de-energised, with the slider reaching a position between the release spring abutment which is free and the element on which it bears.

In the event of manual change-over from electrical to mechanical release it is advantageous for a switch to be associated with the hand actuating mechanism with the switch lying in the battery circuit and being normally closed but being opened by hand by the hand actuating mechanism when the latter is brought into operative connection with the other abutment. This arrangement automatically prevents the supply of residual currents or short circuit currents to the electromechanical converter.

When using a hydraulic release system a practical embodiment of the invention envisages that the electromechanical converter is deenergised in the closed state of the binding and isolates, via a valve, a hydraulic chamber which acts on the retaining means, with the hydraulic chamber being connected via a further valve to a spring accumulator. In the simplest case the further valve can be manually actuated. It can however also be held against the force of an opening spring by a further electromagnetic converter which is energised in the closed state of the binding. In this case the change-over from the electrical control of the release system to a purely hydraulic-mechanical release is fully automatic.

A further solution of the problem underlying the invention features the use of an auxiliary battery in addition to the main battery with the auxiliary battery being connectable, by means of a change-over switch, to the electrically fed elements in place of the main battery. The change-over switch should, in particular, be controlled via a threshold circuit from the output voltage of the main battery. The important advantage of this solution resides in the fact that even with a discharged battery it is still possible to ski for a predetermined distance which, by way of example, is sufficient to ski down to the valley where new batteries can be provided. The same result cannot be achieved by the use of a charge condition indicator for the main battery because, on the one hand, a charge indicator is useless if the skier is inattentive and because, on the other hand, technical difficulties exist in providing a sufficiently accurate indication of the energy which is still stored in the battery.

The preferred automatic change-over from the main battery to the auxiliary battery should however preferably be coupled with an acoustic, or at least an optical warning so that the skier is made aware that a change-over has taken place.

Figure 3:
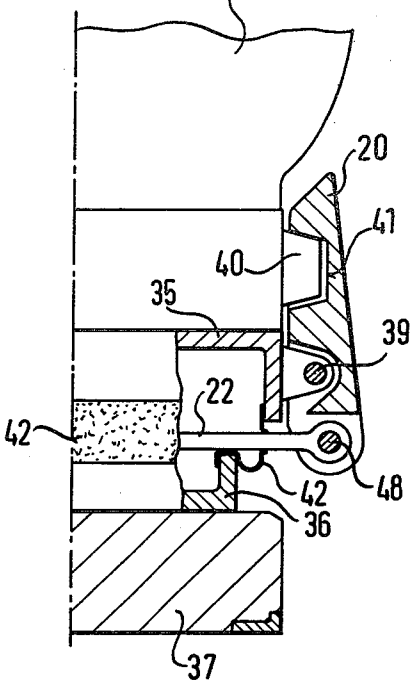
Figure 2:
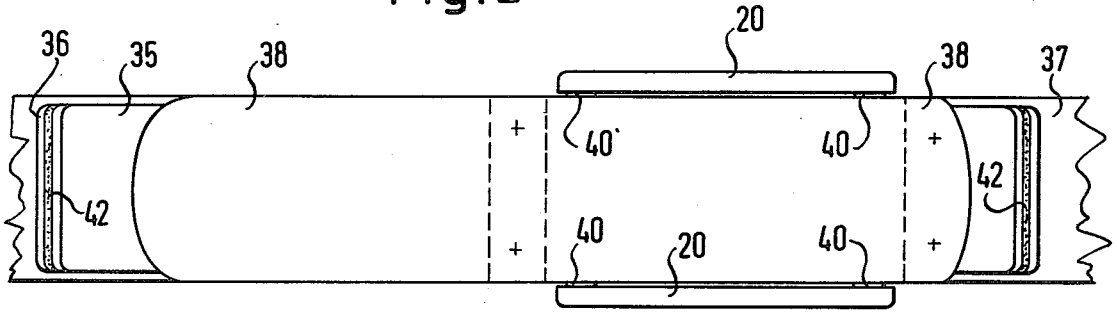
Figure 4:
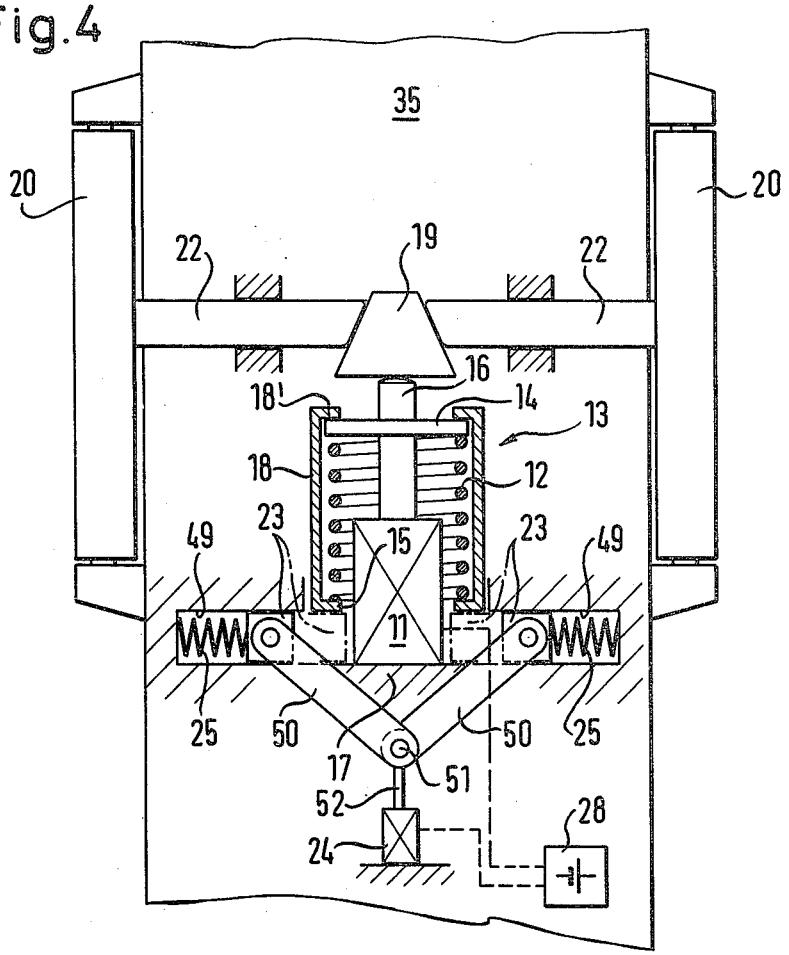
Figure 5:
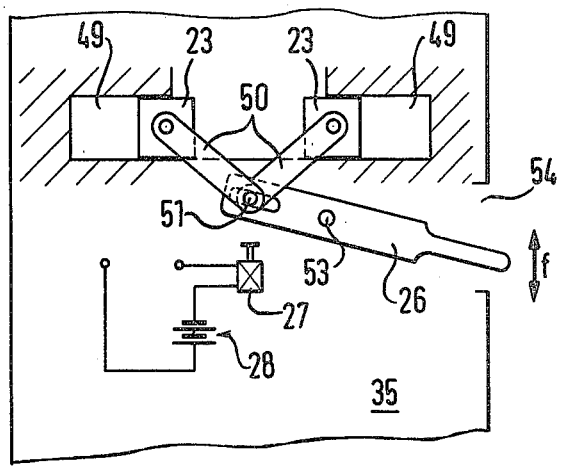
Figure 6:
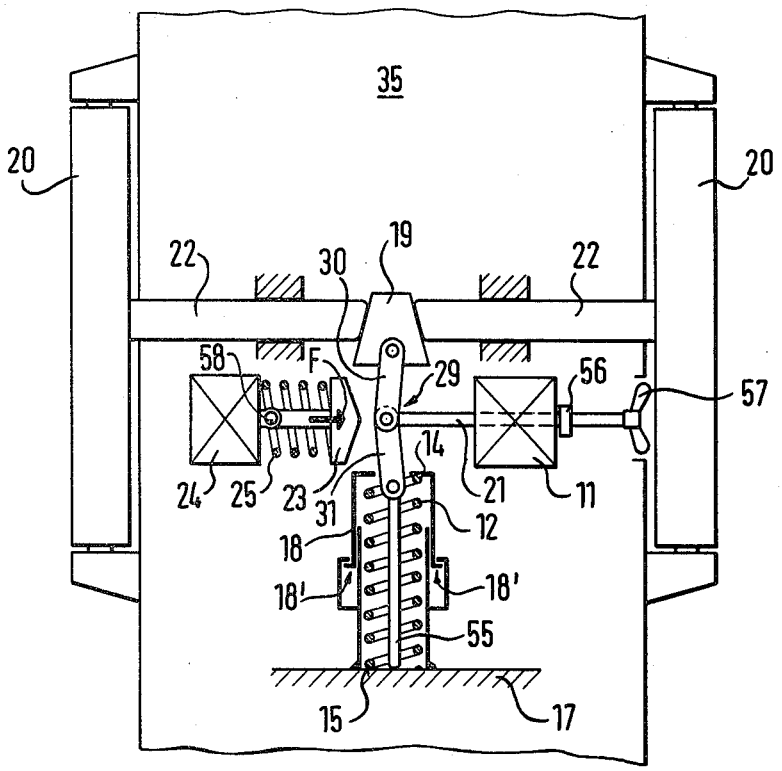
Figure 7:
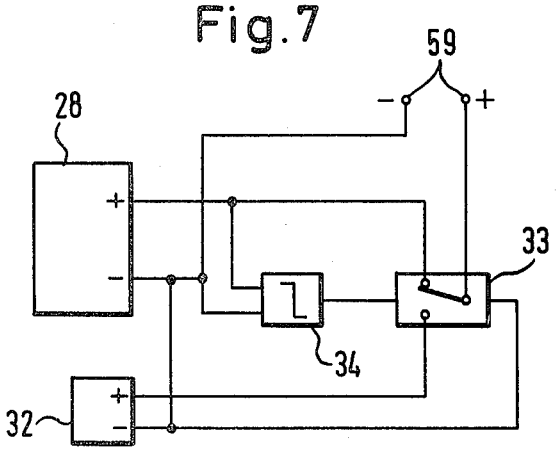
Figure 8:
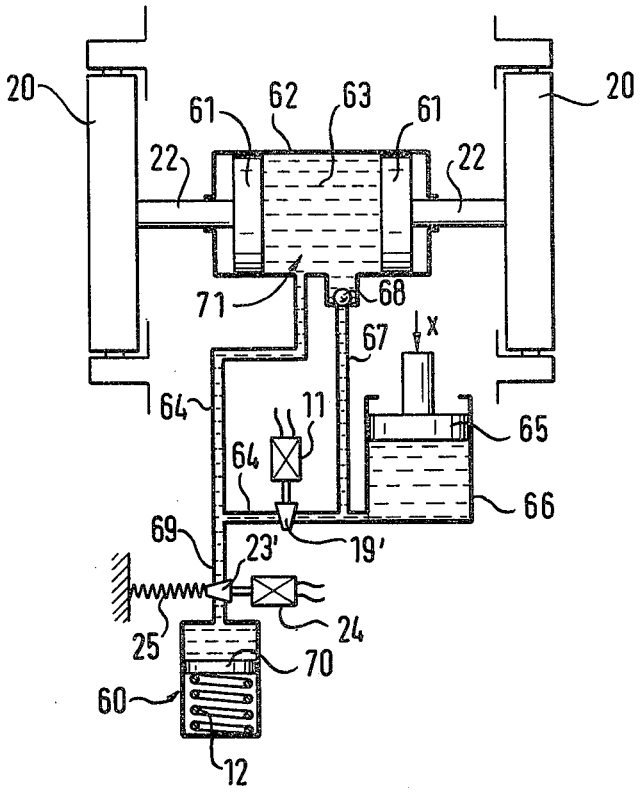

The invention will now be described by way of example only and with reference to the drawings which show:

FIG. 1 a schematic side view of a battery operated electrically releasable safety ski binding with side disposed retaining cheeks, FIG. 2 a schematic plan view of the subject of FIG. 1, FIG. 3 a part of a vertical cross-section through the binding of FIGS. 1 and 2 to illustrate the operation of the side disposed retaining cheeks, FIG. 4 a schematic plan view of a combined electrical and mechanical release system provided in the interior of the binding of FIGS. 1 to 3, FIG. 5 a simplified modification of the embodiment of FIG. 4 with manual change-over, FIG. 6 a view analagous to that of FIG. 4 and showing a further embodiment of the combined electrical and mechanical release system, FIG. 7 a circuit block diagram of an arrangement for changing over from a main battery to an auxiliary battery and FIG. 8 a schematic view of a ski safety binding operating with a hydraulic release system.

Turning firstly to FIGS. 1 to 3 there can be seen a section of a ski 37 to which is fastened a base plate 36. A sole plate 35 is arranged above the base plate 36 and is able to pivot relative to the base plate about at least one and preferably three axes out of the normal position illustrated in FIG. 1 against the force of a spring which is not however illustrated. An arrangement of this kind is disclosed in more detail in the following copending patent applications:

German patent applications No. P 29 48 277.7
U.S. patent applications Ser. No. 210,616
Jap. patent applications Ser. No. 55-169451

A ski boot 38 is arranged on the sole plate 35 and is secured thereon by retaining side cheeks 20 which are pivotable away from the ski boot about axles 39 which are arranged on the sole plate 35 and are directed in the longitudinal direction of the ski. Conical recesses 41 on the inner sides of the side retaining cheeks 20 cooperate with conical projections 40 which are fastened to the sides of the ski boot.

A membrane 42 is provided between the plates 35, 36 around the edges thereof to prevent snow or contamination entering the interior of the binding. When the loads are applied to the skier's leg about one or more of the axes of relative rotation between the plates 35, 36 a measuring transducer or means 43 located between the two plates and indicated schematically in FIG. 1 is subjected to a corresponding load. The measuring transducer or means 43 measures the load applied to a skier's leg during skiing and passes a corresponding electrical signal to a signal former 44. The signal former 44 is housed together with the remainder of the release system in a hollow cavity within the sole plate 35. When the loads on the skier's leg approach a predetermined level the signal former 44 forms a release signal which acts on a release system 13 which is schematically illustrated in FIG. 1. The release system 13 contains an electromechanical converter 11 which is preferably constructed as an electromagnet or solenoid and which bears directly on the side cheeks 20 via a transmission 19, 22 indicated by a chain dotted line.

FIG. 3 shows a part of the transmission 19, 22 and in particular a transversely extending push rod 22 which is coupled with one of the side cheeks 20 via a pivot axle 48 which is disposed in the longitudinal direction of the ski beneath the axle 39. The side cheek 20 can be disengaged from the ski boot 38 by retracting the push rod 22 sideways. An opening spring which is not illustrated can be provided for this purpose. The conical projections 40 also assist the opening movement during raising of the ski boot. The oppositely disposed side cheek 20, which is not shown in FIG. 3, is also provided with a corresponding push rod 22.

FIG. 4 shows in detail how the push rods of the release mechanism 13 are acted on by a solenoid 11 arranged inside the sole plate 35. The solenoid 11 is fixedly arranged relative to the ski in the middle of the sole plate in such a way that its push rod 16 projects forwardly in the direction of the central longitudinal axis of the ski. The push rod 16 bears on a double wedge 19 the inclined surfaces of which co-act with the inner ends of the push rods 22.

Providing the solenoid 11 is energised, the push rod 16 is in its extended position and the side cheeks 20 are held via the wedge 19 and the push rods 22 in the closed position shown in FIGS. 1 to 3.

In accordance with the invention a disk-like spring abutment 14 is provided on the push rod 16 and is acted on by a release spring 12. A further abutment 15 is provided at the other end of the release spring 12 in such a way that the release spring 12 can exert a force on the push rod 16 in a direction which results in clamping movement of the side cheeks 20 when the spring abutment 15 is supported.

In the illustrated arrangement the release spring 12 and the spring abutment 14 are surrounded by a spring cage 18 which has inwardly directed flanges 18' and 15 at its two ends. The front inner flange 18' engages around the spring abutment 14 whereas the other flange 15 forms the further spring abutment for the release spring 12. In the position illustrated in FIG. 4 the inwardly turned flange 18 contacts the front surface of the disk-like spring abutment 14 as a result of an appropriate degree of precompression of the release spring 12. The force of the spring 12 is thereby neutralized and in the FIG. 4 position it is not able to exert any effect on the release mechanism. Release thus takes place in this first arrangement by purely electrical means.

In order to ensure that a mechanical release is possible if the power supply feeding the electrical system becomes discharged, an auxiliary release system is provided which enables the release spring 12 to deflect or yield resiliently. In other words the release spring 12 which in its inoperative state illustrated in FIG. 4 does not take part in the electrical release process is used in a second operative state of the auxiliary release mechanism to enable mechanical release of the binding. For this purpose transversely disposed guide passages 49 are provided in a fixed part 17 of the sole plate to which the electromagnet 11 is also fastened. Sliders 23 are arranged within these guide channels and are displacable in the transverse direction. The sliders 23 are biased inwardly by compression coil springs 25. Links 50 are pivotally connected by their one ends to the sliders about vertical axes and the free ends of the links are connected together at 51 about a vertical axis. The pivot or hinge 51 is acted on in the longitudinal direction of the ski by the push rod 52 of a further solenoid or electromagnet 24. This solenoid is also connected to the same electrical power supply 28 as the solenoid 11 in the manner illustrated in broken lines.

The solenoid 24 exerts a force on the links 50 in such a direction and of such a size that, when the battery 28 is normally charged, the sliders 23 are displaced to the inoperative positions shown in FIG. 4 against the force of the springs 25.

If the battery 28 is discharged the sliders are displaced under the action of the springs 25 into the chain dotted position indicated in FIG. 4. In this position the sliders are located between the part 17 which is fixed relative to the sole plate 35 and the spring abutment 15. As the solenoid 11 is now deenergised it no longer exerts a force on the push rod 16. The push rod 16 does not however move because the sliders 23 hold it in the position shown in FIG. 4 via the spring cage 18, the release spring 12 and the spring abutment 14. From now on the binding functions as a normal ski binding with mechanical release. If an excessive force acts sideways on the side cheeks 20 the push rods 22 push the push rod 16 with the spring abutment 14 inwardly against the force of the spring 12 via the wedge 19 and the ski boot can be mechanically released in an emergency.

As soon as a new battery 28 is inserted the solenoid 24 once again pushes the sliders 23 via the links 50 into the position shown in full lines in FIG. 4 in which the springs 25 are compressed so that the sliders 23 no longer support the spring abutment 15 formed by the rear end of the spring cage 18. At the same time the electromagnet 11 presses the push rod 16 forwardly so that the electromagnet 11 once again ensures the normal position of the side cheeks 20 and so that the binding now once again operates using the main electrical release system.

Whereas, in the embodiment of FIG. 4, the change over from the normal electrical release system to the mechanical auxiliary or emergency release system takes place automatically, FIG. 5 illustrates a simplified embodiment in which this change-over is effected manually. For this purpose the links 50 of the sliders 23 are connected to a hand actuation lever 26 which is pivotable about a vertical axis 53. The hand actuation lever 26 projects sideways and outwardly through an opening 54 in the sole plate 35 and can be displaced by hand in the direction of the double arrow f. In this way the sliders can be selectively brought into engagement with, or moved out of engagement with, the spring abutment 15.

In FIG. 5 the hand actuation lever 26 also cooperates with a switch 27 which is inserted in the power supply circuit of the battery 28. In the electrical release position illustrated in FIG. 5 the switch 27 is closed and all the electrically fed parts of the binding are connected to the battery 28.

If the manual charge-over lever 26 is now pivoted forwardly the sliders 23 move into the position illustrated in chain-dotted lines in FIG. 4. In this position the inner end of the manual change-over lever 26 contacts the switch 27 and opens it. This prevents residual or short circuit currents flowing in the electrical parts of the binding.

Whereas the embodiments of FIGS. 4 and 5 operate with an electrical release mechanism in which release is normally brought about by the electromagnet 11 becoming deenergised FIG. 6 shows an embodiment in which release takes place when the solenoid 11 is energised with a release current. For this purpose the solenoid 11 is disposed in a position at the side of the binding so that its push rod 21 extends in a transverse direction to the overcenter pivot 29 of a toggle lever formed by two toggle lever links 30,31 which are connected together at the overcenter pivot 29. The toggle lever link 30 is pivotally connected at its forward end to the double wedge 19 whereas the rear toggle lever link 31 is supported by a support rod or strut 55 which is braced against fixed structure of the binding namely the part 17 of the sole plate 35.

In the operating position shown in FIG. 6 the toggle lever linkage 30, 31 is in a position slightly to the left of the extended overcenter position which lies on the central longitudinal axis of the ski. As a result of the elasticity of the system the release mechanism is also automatically held in this closed position even when the solenoid 11 is deenergised.

If now the solenoid is acted on by a release signal from the electrical release system it pulls on the rod 21 and the toggle lever linkage moves to the right through the overcenter point. The toggle lever linkage 30, 31 thus reaches an open position in which the double wedge 19 is able to move in the longitudinal direction of the ski substantially without resistance. The side cheeks are thus able to pivot effortlessly away fron the ski boot so that the ski boot is released.

It is important that an abutment 56 is provided on the rod 21 to define the position shown in FIG. 6 slightly beyond the overcenter position and to prevent the toggle lever linkage 30, 31 deflecting further to the left. A knob 57 for manual actuation should in addition project sideways out of the sole plate 35 so that the binding can be manually returned to the closed position. If the power supply fails so that the solenoid 11 can no longer be energised the binding is no longer able to release in the previously described manner. In order to make an emergency or auxiliary release possible a slider 23 is provided on the opposite side of the toggle lever linkage 30, 31 to the solenoid 11. The slider 23 can be displaced in the direction of the arrow F either by hand or by means of a spring 25, i.e. in a direction towards the rod 21 against the toggle lever linkage 29. When the slider 23 abuts on the toggle lever joint 29 the toggle lever linkage 30, 31 is caused to move to the right in FIG. 6 so that the toggle lever linkage is no longer able to hold the side cheeks 20 in their closed position. At the same time the slider 23, which is appropriately dimensioned, engages between the double wedge 19 and the spring abutment 14 for the release spring 12 which extends from the aforementioned spring abutment 14 to a further spring abutment 15 formed on a fixed part 17 of the sole plate 35. The spring 12 is once again surrounded by a spring cage 18 which consists of two parts which are connected together by suitable flange-like abutments 18'. In the normal electrical operating position of FIG. 6 the two part spring cage 18 neutralizes the force of the spring 12 in the manner shown in FIG. 6.

As soon as the slider 23 has pushed the toggle lever linkage through the over-center position the head of the slider 23 becomes firmly engaged between the double wedge 19 and the spring cage 18. The spring cage 18 can be compressed against the force of the release spring 12 by forces transmitted from the double wedge 19 through the slider 23.

As the toggle lever linkage 30, 31 has now been displaced to the right the release spring 12 acts on the side cheeks 20, in the manner of a normal mechanical release spring, via the slider 23 and the transmission 19, 22.

After inserting a new battery the slider 23 can be once again withdrawn from its position between the double wedge 19 and the spring abutment 14 of the cap 18. The toggle lever linkage 30, 31 is then moved back to the position illustrated in FIG. 6 by means of the manually actuated knob 57 whereupon the binding can once again be electrically released without the mechanical release system affecting the release in any way.

The slider 23 can, as already stated, be introduced manually into its working position. FIG. 6 however illustrates a preferred arrangement in which a further solenoid 24 is used to retain the slider 23 in its inoperative position against the force of the spring 25 during electrical operation. If the power supply fails, or if a short circuit develops, then the slider 23 is automatically moved under the action of the spring 25 into the above described operative position, i.e. to a second operative state.

The slider 23 should be fastened to the push rod of the solenoid 24 via a pivotal joint 58 so that the slider 23 can follow the movements of the double wedge 19 and the spring cage 18 when the auxiliary release system is in operation. In the embodiment of FIG. 7 the main battery 28 of the ski safety binding is connected to terminals 59 which supply the electrical release system via a change-over switch 33. The change-over switch is normally in the position illustrated in FIG. 7 in which the terminals 59 are connected to the two poles of the main battery 28.

The change-over switch 33 is a controlled switch which can be changed over via a threshold circuit 34 which is connected to the output potential of the main battery 28. If the output potential of the main battery 28 falls below a certain value the change-over switch 33 changes over to another position in which it connects an auxiliary battery 32 to the terminals 59. The auxiliary battery 32 is so dimensioned that it can continue to feed the electronic release system until it is possible to exchange the main battery 28.

In the embodiment of FIG. 8 a hydraulic release system is provided in place of the mechanical release system. The push rods 22 are attached to hydraulic pistons 61 which are displacably arranged facing one another in a hydraulic cylinder 62 which extends transversely to the longitudinal direction of the ski. An incompressible pressure fluid 63 is located in the hydraulic chamber 71 within the cylinder 62. The hydraulic chamber 71 containing the pressure fluid 63 is connected via a line 64 and a valve 19' to a hydraulic cylinder 66 which contains a piston 65. A predetermined pressure can be generated in the hydraulic cylinder 66 by exerting a force in the direction of the arrow X, for example by means of a spring, and this pressure can be communicated to the hydraulic chamber 71 via a line 67 and a non-return valve 68.

The valve 19' is acted on by the electromechanical converter 11 which, in the present case, is once again constructed as a solenoid and is controlled in the same manner as the electromagnet of the embodiment of FIG. 6. A hydraulic line 69 branches off from the line 64 and is connected to a spring accumulator 60 via a further valve 23'. The spring accumulator 60 contains the emergency release spring 12. This emergency release spring exerts a resetting force on a piston 70 arranged in the spring accumulator 60.

The pressure fluid in the lines 64, 69 acts on the surface of the piston 70 remote from the spring 12.

The manner of operation of the embodiment of FIG. 8 is as follows:

In order to close the binding a suitable pressure is exerted in the direction of the arrow X on the piston 65 and is communicated via the non-return valve 68 to the hydraulic chamber 71. In this way the pistons 61 are pressed apart from one another and move the side cheeks 20 into the closed position. The deenergised, solenoid actuated valve 11, 19' is held closed by means of a spring which is not however illustrated. The solenoid 24 is however energised so that the valve 23' is closed against the force of the spring 25. The hydraulic chamber 71 is now closed on all sides so that the piston 61, 61' are substantially unable to move inwardly even when an opening force is exerted on the side cheeks 20.

As soon as the measurement transducer 43 of FIG. 1 measures a dangerous load on the skier's leg current is applied to the solenoid 11 via the signal former 44 with the result that the valve 19' opens and the pressure in the hydraulic chamber 71 can be dissipated by return movement of the piston 65.

As soon as the current is once again removed from the solenoid 11 the valve 19' shuts and the pressure in the hydraulic chamber 71 can be reestablished by depression of the piston 65.

If the power supply fails the solenoid operated valve 11, 19' remains closed. The electromagnet 24 is however no longer able to hold the valve 23' closed so that this valve is opened by the spring 25. The spring accumulator 60 is now connected with the hydraulic chamber 71. In the event of an excessive force being exerted sideways on the side cheeks 20 from the ski boot the piston 70 can move against the force of the spring 12 so that pressurized fluid escapes from the cylinder 62 and the side cheeks 20 can move sideways. This arrangement allows a hydraulic-mechanical release to be achieved.

Other arrangements will be apparent to those skilled in the art without departing from the scope of the present teaching.

We claim:

1. An electrically releasable safety ski binding comprising a fixed binding part; retaining means for releasably retaining a ski boot in the binding; a battery operated power supply; electrical measuring sensor means for sensing the load on a skier's leg; a signal former connected to said electrical measuring sensor means for forming a release signal when said load reaches a predetermined value; a release mechanism including an electromagnetic converter, wherein said electromagnetic converter is responsive to said release signal to release said retaining means for movement away from said ski boot; a normally inoperative release spring associated with said release mechanism, said release spring having first and second ends; and means for placing said release spring in an operative state on failure of said power supply; wherein, in said operative state, said release spring is disposed operatively in parallel with said electromagnetic converter, with said first end being braced against a fixed housing part and said second end bearing on said release mechanism; and wherein said release spring is arranged to yield in said operative state to permit release of said binding once a predetermined release setting is reached.

2. A safety ski binding in accordance with claim 1 and wherein means are provided for placing said electromagnetic converter in a condition in which said release spring can yield to permit release of said binding on failure of said power supply.

3. A ski binding in accordance with claim 1 wherein said release mechanism is a mechanical release mechanism, the ski binding further comprising a cage having first and second ends for retaining said release spring in an inoperative state, and wherein said means for placing said release spring in an operative state comprises movable slider means which can be brought into operative engagement with one of said cage ends to permit yielding of said release spring.

4. A ski safety binding in accordance with claim 3 and further comprising a hand actuated mechanism for moving said slider means.

5. A ski safety binding in accordance with claim 4 and further comprising a switch associated with said hand-actuated mechanism, said switch lying in said power supply circuit and being normally closed but being opened by said hand-actuated mechanism when the latter is actuated to move said slider means into engagement with said spring cage.

6. A ski safety binding in accordance with claim 3 and further comprising a second electromagnetic converter, wherein both said first and second electromagnetic converters are fed from said power supply circuit, and wherein said second electromagnetic converter is adapted to retain said slider means in an inoperative position against the force of an auxiliary retaining spring, and wherein said auxiliary retaining spring brings said slider means into operative engagement with said spring cage when said second electromagnetic converter becomes deenergised on failure of said battery energised power supply circuit.

7. A ski safety binding in accordance with claim 6 wherein the first said electromagnetic converter comprises a solenoid with an associated push rod and wherein, in the energised condition of said solenoid, said push rod holds said retaining means in a ski boot retaining position via a transmission.

8. A ski safety binding in accordance with claim 7 and wherein one of said cage ends engages an abutment arranged on said push rod.

9. A ski safety binding in accordance with claim 1 wherein the release of said retaining means from said ski boot takes place when said electromechanical converter becomes deenergised.

10. A ski safety binding in accordance with claim 1 and characterized in that the release of the retaining means occurs when the electromagnetic converter is energised and in that a push rod of the electromagnetic converter is movable when the power supply fails.

11. A ski safety binding in accordance with claim 10 and characterized in that the push rod of the electromechanical converter operates on a overcenter joint of a toggle lever which holds the binding closed and is extended or located trivially beyond the extended overcenter position and in that, on being energized, the electromagnetic converter moves the toggle lever out of the closed position, if necessary through the overcenter point, into an open position.

12. A safety ski binding in accordance with claim 11 and characterized in that the push rod can be moved by hand into the open position.

13. A ski safety binding in accordance with claim 11 and characterized in that a slider is held by a further electromagnetic converter, which is supplied from the same power supply as the main converter, in its inoperative position against the force of an auxiliary spring in such a way that the auxiliary spring pushes the toggle joint beyond its overcenter position into the open position via a slider when the further electromagnetic converter becomes deenergised with the slider reaching a position between a release spring abutment which is free and the element on which it bears.

14. A ski safety binding in accordance with claim 1 and having a hydraulic release system, characterized in that the electromagnetic converter is deenergised in the closed state of the binding and isolates, via a valve, a hydraulic chamber which acts on the retaining means and in that the hydraulic chamber is connected via a further valve to a spring accummulator.

15. A ski safety binding in accordance with claim 14 and characterized in that the further valve can be actuated manually.

16. A ski safety binding in accordance with claim 14 and characterized in that the further valve can be acted on against the force of an opening spring by a further electromagnetic converter which is energised in the closed state of the binding.

17. An electrically releasable safety ski binding comprising retaining means for releasably securing a ski boot to a ski, a battery operated power supply, measuring means for measuring the load applied to a skier's leg during skiing, a signal former connected to said measuring means for forming a release signal when said load approaches a predetermined level, a release mechanism incorporating an electromagnetic converter responsive to said release signal to initiate release of said retaining means, said safety binding further comprising an auxiliary release mechanism having a first inoperative state and a second operative state in which it is operative to permit safety release of the binding and wherein means are provided for automatically selecting said second operative state on failure of said power supply.

18. A safety ski binding in accordance with claim 17 wherein said battery operated power supply includes a main battery and wherein said auxiliary release mechanism comprises an auxiliary battery having a first inoperative state in which it is disconnected from said release mechanism and a second operative state in which it is connected to said release mechanism and wherein said means for selecting said second operative state comprises means for sensing failure of said electrical power supply and switch means for connecting said auxiliary battery to said battery operated power supply in place of said main battery.

19. A safety ski binding in accordance with claim 17 and wherein said auxiliary release mechanism comprises resilient spring means which is able to yield resiliently to permit release of the binding in said second operative state.

20. An electrically releasable safety ski binding comprising retaining means for releasably securing a ski boot to a ski, an electrical power supply, measuring means for measuring the load applied to a skier's leg during skiing, a signal former connected to said measuring means for forming a release signal when said load approaches a predetermined level, a release mechanism incorporating an electromagnetic converter connected to receive said release signal and operative to initiate release of said retaining means on receipt of said release signal, said safety binding further comprising an auxiliary release mechanism incorporating resilient release movement permitting means and having a first, inoperative state and a second, operative state in which said resilient means is able to deflect resiliently under loads applied to said retaining means via said ski boot to permit release of the binding on reaching a release setting thereof and means for automatically selecting said second operative state on failure of said electrical power supply.

21. A safety ski binding in accordance with claim 20 and wherein said resilient release movement permitting means comprises spring means in the form of at least one coil spring.

22. A safety ski binding in accordance with claim 21 and wherein said spring means has first and second ends, with one of said ends bearing on abutment means of said release mechanism and the other of said ends bearing on either a fixed structure of the binding or a spring cage carried by said release mechanism, and wherein said auxiliary release mechanism comprises means cooperable with one end of said spring means in said second operative state to communicate forces from said retaining means to said coil spring means to deflect the same thereby permitting release of the binding.

* * * * *